United States Patent [19]

Anderka

[11] Patent Number: 4,854,205

[45] Date of Patent: Aug. 8, 1989

[54] SIGN CUTTING DEVICE

[75] Inventor: Gerold Anderka, Ellerbek, Fed. Rep. of Germany

[73] Assignee: Rotring-werke Riepe KG, Hamburg, Fed. Rep. of Germany

[21] Appl. No.: 192,078

[22] Filed: May 10, 1988

[30] Foreign Application Priority Data

Aug. 29, 1987 [DE] Fed. Rep. of Germany ..... 3729208

[51] Int. Cl.[4] ..... B26D 5/08

[52] U.S. Cl. ..... 83/529; 83/429; 83/436; 83/588; 83/881; 83/925 CC; 33/18.1

[58] Field of Search ..... 83/881, 925 CC, 879, 83/886, 582, 428, 563, 588, 529, 527, 436; 33/18.2, 18.1, 1 M; 225/96, 96.5; 346/141, 139 R; 101/127, 127.1; 400/136, 17, 18, 19

[56] References Cited

U.S. PATENT DOCUMENTS

| | | | |
|---|---|---|---|
| 3,760,669 | 9/1973 | Rosenthal et al. . | |
| 4,038,124 | 7/1977 | Griswold et al. | 83/881 |
| 4,137,803 | 2/1979 | Goldinger | 83/881 |
| 4,291,824 | 9/1981 | DeTorre | 83/881 |
| 4,467,525 | 8/1984 | Logan | 83/879 |
| 4,503,744 | 3/1985 | Garner et al. | 83/881 |
| 4,512,839 | 4/1985 | Gerber . | |
| 4,524,894 | 6/1985 | LeBlond . | |
| 4,608,891 | 9/1986 | Frisby et al. . | |
| 4,624,169 | 11/1986 | Nelson | 83/881 |
| 4,628,784 | 12/1986 | Gach | 83/881 |

FOREIGN PATENT DOCUMENTS 3313770 8/1986 Fed. Rep. of Germany .

*Primary Examiner*—Frank T. Yost
*Assistant Examiner*—Scott A. Smith
*Attorney, Agent, or Firm*—Fitzpatrick, Cella, Harper & Scinto

[57] ABSTRACT

A cutting device comprising a support roller (8) freely rotatable in both directions to absorb the pressure of cutting, and a carrier (9) movable in the direction of the longitudinal axis of the support roller (8) on which is fastened a cutting tool (26,27) which can be brought into contact with the roll of material to be cut and present on the support roller (8). The improvement comprises lowering of the cutting tool (26,27) into an operating position, and raising from the operating position, by turning of an eccentric element (14,34) coupled with a pivotable arm (17) holding the cutting tool (26,27). The cutting tool (26,27) is suspended on the arm (17) and thereby limited in regard to its raising and lowering movement. A leaf spring (21) fixed on the arm (17) is braced on the upper end (28) of the cutting tool (26,27) to exert a penetrating force on the cutting tool (26,27) when the arm (17)is lowered.

32 Claims, 5 Drawing Sheets

SIGN CUTTING DEVICE

BACKGROUND OF THE INVENTION

1. Field of the Invention

The present invention relates to a cutting device particularly for signmaking, having a support roller which is freely rotatable in both directions to absorb the pressure of cutting, and a carrier movable in the direction of the longitudinal axis of the support roller. A cutting tool fastened on the carrier is pushed into contact with a portion of a roll of material to be cut that is present on the support roller. A lowering of the cutting tool into the operating position, and a raising from the operating position, is accomplished by turning of an eccentric element coupled with a pivotable arm holding the cutting tool.

2. Brief Description of the Prior Art

Sheet cutting devices are known, e.g., LOGAN et al., (U.S. Pat. No. 4,467,525) that particularly are adapted to cut letters, characters or the like from a roll of double-layered foil, in order to produce signs, templates for painting or spray-painting work, handwritten characters or the like.

In connection with this type of cutting it is important that the layer of the foil located the farthest outside (with respect to the support roller) is cut through completely by the cutting tool, but that the base foil located underneath at most is scored, but under no circumstances cut through. However, since the foil materials to be used are of different thickness and different strength, the cutting device and its cutting tool should be adjustable in such a way that an exact control over penetration depth of the cutting tool, as required for each respective material, is attained. In the known cutting device according to LOGAN, et al. (U.S. Pat. No. 4,467,525), a heated cutting tool is utilized, and its temperature is adjusted in such a way that the exact penetration depth desired is attained by means of the combination of a melting process created by the cutting tool and the weight of cutting tool and its supporting arm. However, if a mechanical cutter is used in that known cutting device, the penetration depth is only from the influence of the weight of the cutting tool and the arm, so that adaptation to different material thicknesses, and material strengths, is not easily possible.

One prior art approach to the penetration depth problem is an interchangeable weight body that is placed on the upper end of the cutting tool. This approach is used in a Grafion TM sheet cutting device made by N. V. Grafityp of Houthalen, Belgium, wherein a required depth penetration adaptation is achieved by changing the weight of the cutting tool assembly. However, this approach makes it necessary to move comparatively large masses when the cutting tool is brought into contact and out of contact with the material to be cut and, furthermore, the penetration adaption is very cumbersome for the user.

SUMMARY OF THE INVENTION

It is an object of the invention to improve NC controlled sheet cutting devices such that the penetration depth of the cutting tool into the material to be cut can be achieved in a simple manner, and in conformity to the dimensions and properties, of the sheet material.

To attain this object, an improved sheet cutting device of the type mentioned above is designed in accordance with the invention so that a cutting tool supported on an arm has limited raising and lowering movement, and a leaf spring fixed on the arm is braced on the upper end of the cutting tool. The distance between the front tip and the upper end of the cutting tool also is greater than the minimum distance of that portion of the relaxed leaf spring-which normally rests on the upper end of the cutting tool-from the top of the support roller, when the cutting tool is absent.

Thus, in a cutting device of the invention the penetrating force of the cutting tool generally is not generated by weight, but through the action of a leaf spring which acts on the upper end of the cutting tool. After a lowering of the arm holding the suspended cutting tool, the leaf spring is deformed by a length sufficient to set down the front end of the cutting tool on the material to be cut and keep it there without the cutting tool being supported by the arm. Thus, the leaf spring exerts the force on the cutting tool that presses it into the material to be cut. The deformation of the leaf spring, and the force acting on the cutting tool thereby increases as the arm is lowered. The leaf spring is fixed on the arm and cannot follow this lowering movement, due to bracing of the leaf spring on the upper end of the cutting tool and, instead, the spring accordingly is bent.

It should be mentioned that the term "upper end of the cutting tool" refers to an area that is distant from the cutting edge; however, the "upper end" need not be the point of the cutting tool that is farthest away from the cutting edge.

In this way, the user, by means of a controlled lowering of the arm holding a cutting tool suspended in its raised position, easily may adjust the penetrating force acting on the cutting tool, so that the cutting tool penetrates the material to be cut to exactly the desired depth.

It also should be mentioned that LOGAN et al., (U.S. Pat. No. 4,467,525) states that a general use cutting tool may be replaced by a drawing tool (perhaps in the form of a rolling ball pen) in order to draw or write in a controlled manner on material to be cut later. For this purpose the arm, which normally carries a cutting tool, but instead of a cutting tool now supports a drawing tool, is said optionally to be spring-loaded in order to obtain a sufficient pressure force for the drawing tool. However, in this regard the structure of any spring to be so used is not described, nor is any adjustability provided for. Furthermore, no spring device at all is implied to be useful, when a cutting tool normally is employed.

To maintain the leaf spring in a defined position on the arm most simply, the spring may be fixed at a first vertical protrusion of the arm that is provided between a portion braced on the upper end of the cutting tool and the pivot axis. The spring additionally may be braced on a second vertical protrusion in the vicinity of the pivot axis, having the same elevation as the first protrusion.

By this means, the end of the leaf spring opposite the end being deformed (by the displacement of the arm) is braced in such a way that the leaf spring end deformation does not result in a pivoting of the leaf spring around its fastening on the first protrusion. In other words, the leaf spring does not pivot around the first protrusion fastening such that its deformation no longer takes places in an exactly defined manner.

When the leaf spring is fixed in such manner, there further is a downwardly facing bearing surface, preferably below the upper end of the cutting tool, against which the straight arm for raising and holding the cutting tool can be brought upwardly and into engagement. The distance of the bearing surface from the upper end of the cutting tool preferably is equal to the height of the first protrusion.

Hence, the leaf spring remains undeformed as long as the straight arm is in engagement with the bearing surface and, thereby, suspends the cutting tool secure against further lowering. As soon as the arm moves away downwardly from the bearing surface, deformation of the leaf spring results and, as a consequence, a force is generated to press the cutting tool downwardly, against the material to be cut.

The cutting tool can be maintained axially, or vertically, movable back and forth by use of a stationary guide sleeve. In this case, at least one radially outwardly extending pin can be provided on the cutting tool to engage with an upwardly open slit in the guide sleeve that extends in an axis-parallel direction. By means of the engagement of the pin on the cutting tool within the slit in the guide sleeve, a twisting of the cutting tool within the guide sleeve is prevented, on the one hand. On the other hand, further lowering of the cutting tool is limited by a resting of the pin against the bottom of the slit. Hence, it can be assured that the cutting tool will not cut into the support roller, even in case of an operating error.

An eccentric shaft may be used as an eccentric element, and may be connected with the arm by means of a connecting rod. The eccentric shaft may be drivingly connected with a step motor. For example, the arm can be moved back and forth by controlled turning of the eccentric shaft through a toothed belt, between a raised position, in which the cutting tool is out of contact with the material to be cut, and a pre-set lowered position, in which the cutting tool is pressed into the material to the desired depth with the required pressure generated by the leaf spring.

A preferred embodiment of the invention will be described in detail below with reference to the accompanying drawings.

DETAILED DESCRIPTION OF THE PREFERRED EMBODIMENT

Figure 1:
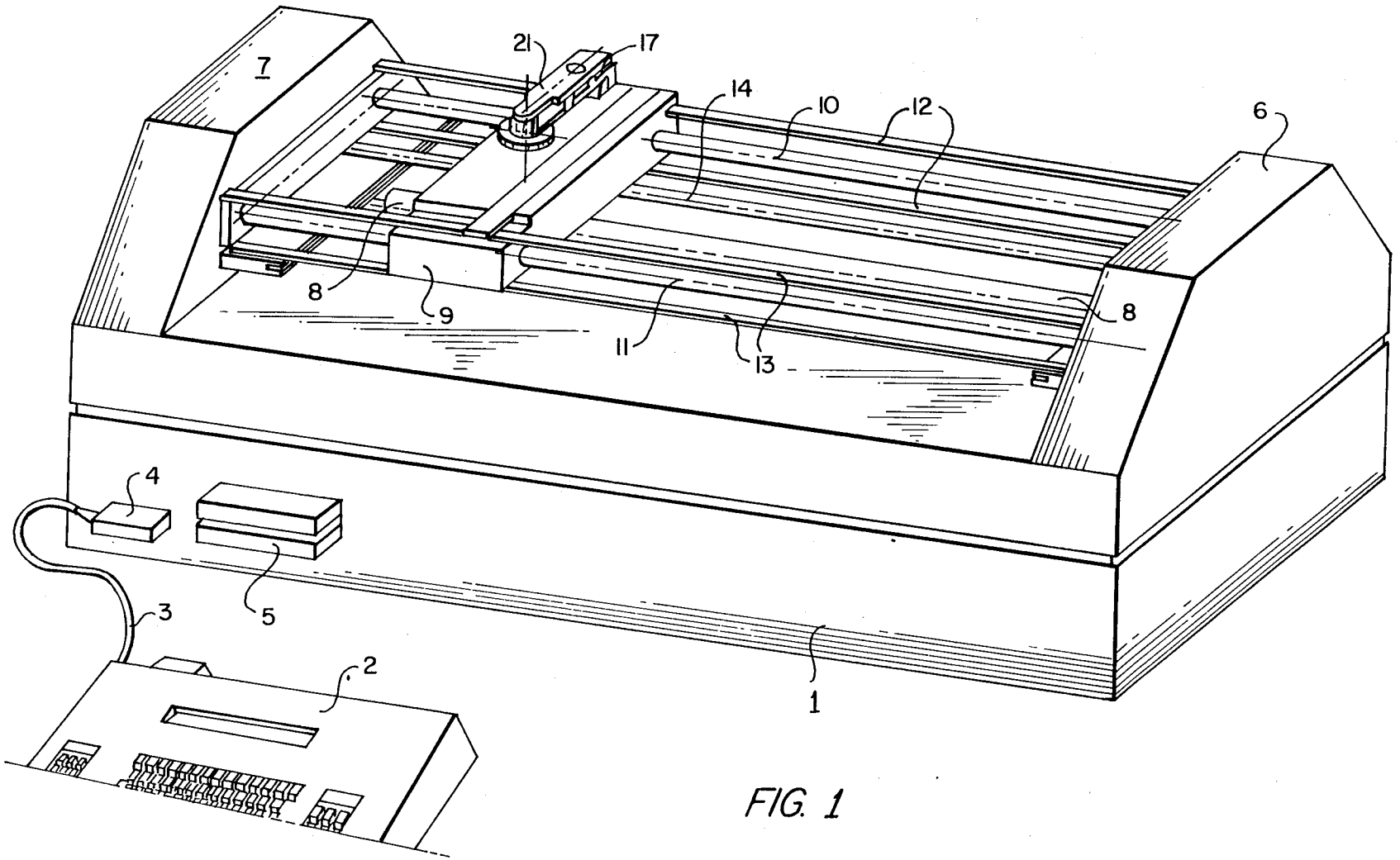
FIG. 1 is a simplified perspective view of a cutting device and a keyboard for the input of control commands coupled with it.

The cutting device shown in FIG. 1 is, in its basic operating elements, similar to prior art cutting devices such as that shown in LOGAN et al., (U.S. Pat. No. 4,467,525). Hence, there is no need to show details of the NC control nor to discuss the input of control commands or the like, to understand the specific improvements taught herein.

It also should be noted that the cutting tool to be described hereafter customarily is oriented with its cutting or engagement edge such that the cutting or engagement edge is oriented tangentially to the direction of its movement along the path of a cut. The means to implement such a conventional tangential cutting control can be understood by reference to LOGAN et al. (U.S. Pat. No. 4,467,525) or to the Grafion TM machine manufactured by N. V. Grafityp, discussed hereinbefore. Hence, such prior art cutting controls also are not discussed when describing the preferred embodiment.

As shown in FIG. 1, a cutting device conventionally is located in a housing 1 comprising two side pieces 6, 7 between which are loacted guide bars 10, 11 for a carrier 9 movable along these guide bars. Endless toothed belts 12, 13 are fixed on the carriage 9, and move the carriage 9 in a controlled manner back and forth along the guide bars 10, 11 through a customary drive (not shown).

The movement of the carriage is controlled by commands which are input into a control unit (not shown). The cutting unit and keyboard 2 are connected conventionally by means of a cable 3 and a plug interface 4, on the cutting device. The control unit additionally may be connected with ROM program cassettes 5 that are exchangeable and by means of which it is possible to generate, for example, different scripts and characters. Optionally, the font control unit may correspond to the control illustrated by LOGAN et al. (U.S. Pat. No. 4,467,525).

A support roller 8 is located below the carriage 9. An adjustable tractor driving means (not shown) guides a roll of material to be cut (usually a double-layered plastic film) by back and forth movements perpendicular to the axis of the roller. Hence, the tractors define one coordinate of the course of the cut to be made. The tractors optionally may be non-adjustable pins that are part of the support roller 9, for example, as shown in LOGAN et al. (U.S. Pat. No. 4,467,525), thereby feeding the material as the roller is caused to turn around its longitudinal axis.

Figure 2:
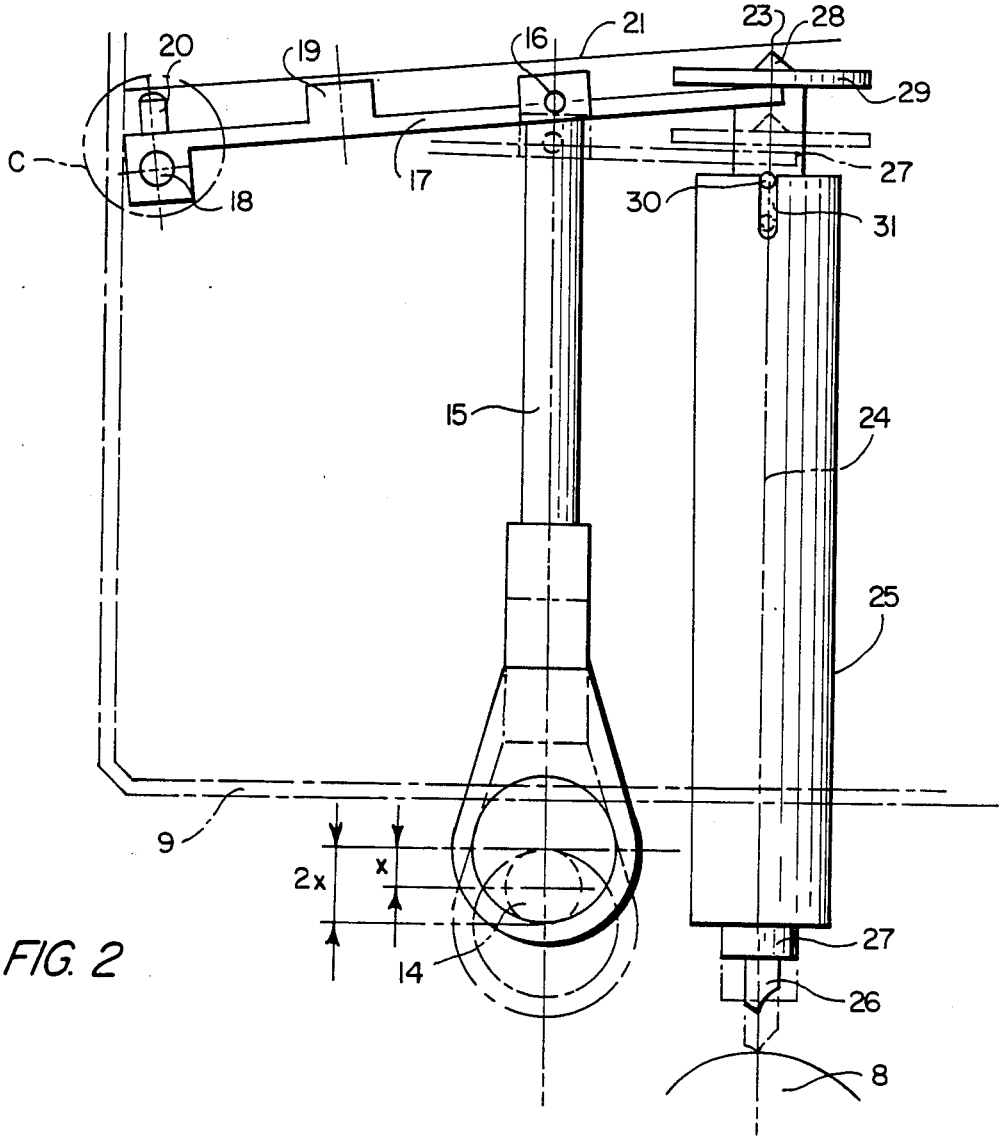
FIG. 2 is a schematic view of the cutting tool disposed in a guide sleeve and held suspended by means of an arm supporting a leaf spring, with the lowered position of the arm being indicated by dash-dotted lines.

A guide sleeve 25 on the carriage 9 supports a cutting tool 26, 27, so as to be movable back and forth in the direction of the longitudinal axis 24 of the guide sleeve 25. Hence, the cutting element 26 provided at the forward end can be moved between a raised position (solid line in FIGS. 2 and 3) and a lowered operating position (dash-dotted in FIGS. 2, 4, and 5), in which the cutting element 26 is in cutting engagement with the portion of the material to be cut that is directly over the support roller 8.

As already mentioned, the cutting tool may be supported so as to be pivotable around the axis 24 or may be turned by a drive, for which a corresponding pivotable support (not shown) of the guide sleeve 25 may be provided.

At the upper end of the guide sleeve 25 there is a slit 31, upwardly open and extending in an axis-parallel direction, which is engaged by a transverse pin 30, that extends radially outwardly from the cutting tool 26, 27. Hence, the cutting tool is maintained secure against rotation in the guide sleeve 25. On the cutting tool 26, 27, above the pin 30 and at a distance from the pin, an annular collar 29 is located to form a downwardly facing, lower bearing surface, against which will engage a point 23, that is concentric to the axis 24.

Figure 3:
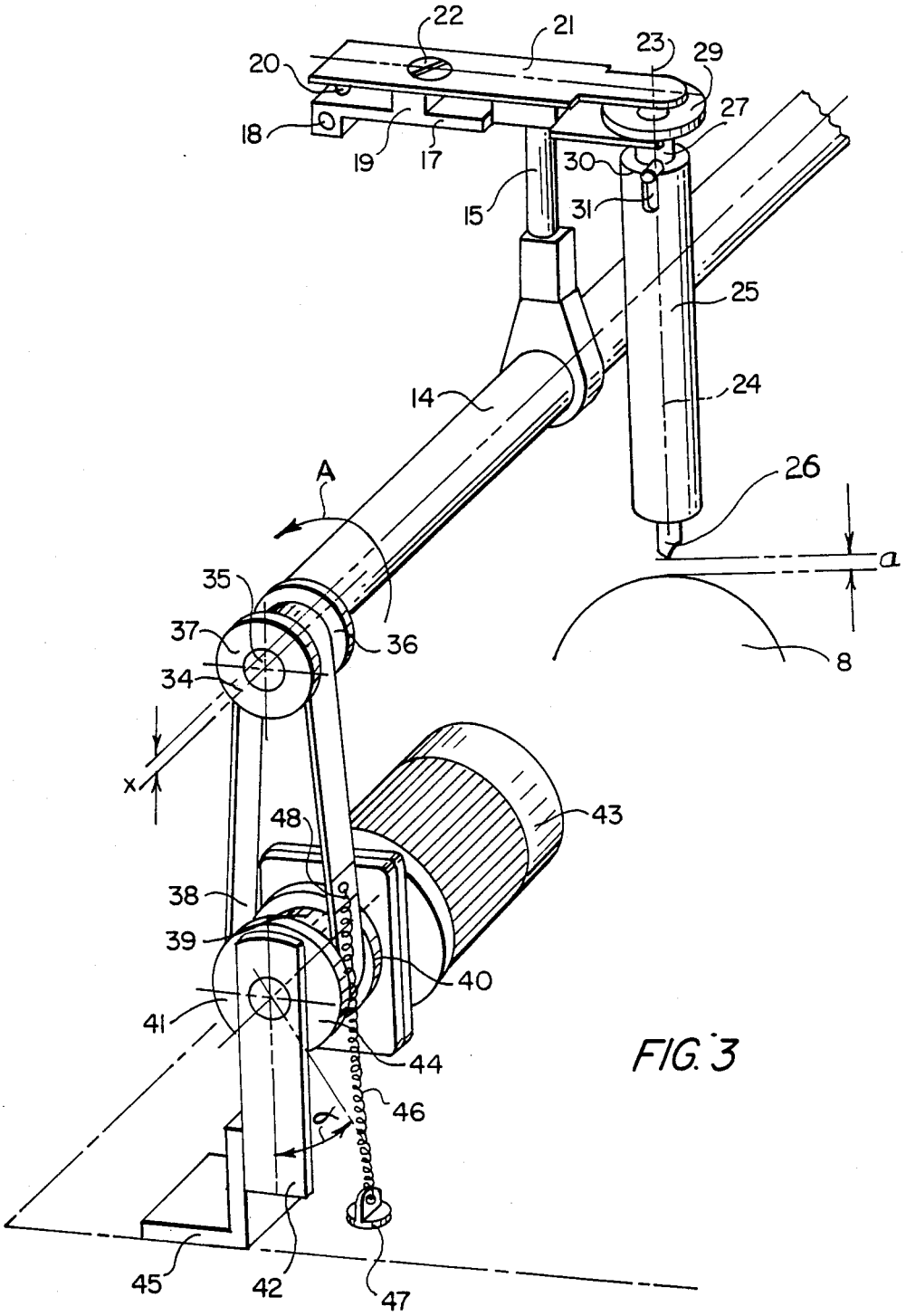
FIG. 3 is a perspective partial section view of the cutting tool fastened in a guide sleeve, together with the parts for moving it and putting it under spring pressure, wherein the cutting tool is in a raised position.
Figure 5:
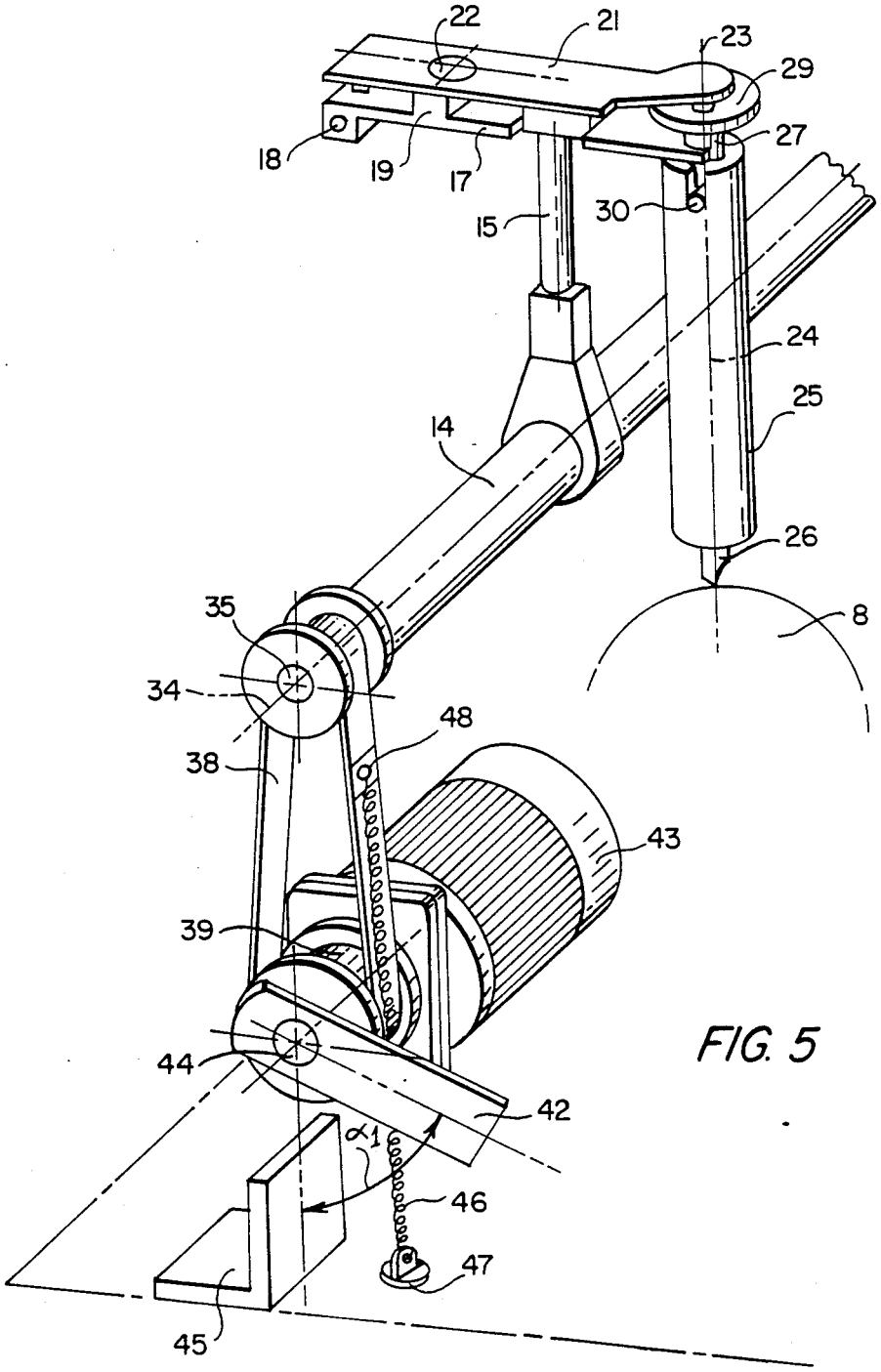
FIG. 5 is a view corresponding to FIG. 4, with the cutting tool in a lowered position, under an increased spring pressure.

Furthermore, a straight arm 17, that is pivotable around a shaft, 18, has a proximate end fastened on the carriage 9 and a distal end that is forked. The distal end extends horizontally and below an annular collar 29 on both sides of the cutting tool 26, 27. The upper end of a connecting rod 15 is pivotable around an axis 16 and fastened to the straight arm 17, at a point that is between a pivot shaft 18 at the arm proximate end and the fork, at the arm distal end. The lower end of the connecting rod is fastened so as to be axially slidable on an eccentric shaft 14. The shaft 14 has an offset shaft segment 35, that is pivotable on a longitudinal axis 34 in a manner yet to be described, with the offset being shown in FIG. 3 as an eccentricity, x, with respect to the central axis of the eccentric shaft 14. Thus, if a turn of the eccentric shaft 14 is performed, a displacement in height occurs with respect to the shaft segment 35 that corresponds to the degree of turning. At maximum, the displacement is twice the amount of the eccentricity, x, (FIG. 3), as indicated by the small dashed circle in FIG. 2 that is located inside the eccentric shaft 14, shown in solid and dash-dotted lines. In this manner, the straight arm 17 can be pivoted by turning the eccentric shaft 14 between a raised position (solid line in FIG. 2; FIG. 3) and a maximally lowered position in which the forked end of the arm 17 comes to rest on the upper end surface of guide sleeve 25 (FIG. 5).

An upwardly directed first protrusion 19 is formed on the arm 17 roughly midway between the pivot shaft 18 and its forked end. The leaf spring 21 is fastened to the first protrusion by means of a screw 22. The leaf spring rests with one end extending past the screw 22 in the direction of the pivot shaft 18, and there contacts a second protrusion 20, of equal height to that of the first protrusion 19. In the other direction, the leaf spring 21 extends just beyond a bearing point 23 of the cutting tool 26, 27 and thereby the spring is contacted against the top of the cutting tool.

In the position of the straight arm, 17, mentioned above, and as shown by solid lines in FIG. 2, 3, the distal or forked end of the arm 17 rests against the lower bearing surface of the annular collar 29. Hence, the arm 17 suspends the cutting tool 26, 27 above the support roller, 8, such that the lower end of the cutting element 26 is at a distance, a, above the closest, adjacent point of the support roller 8.

Figure 4:
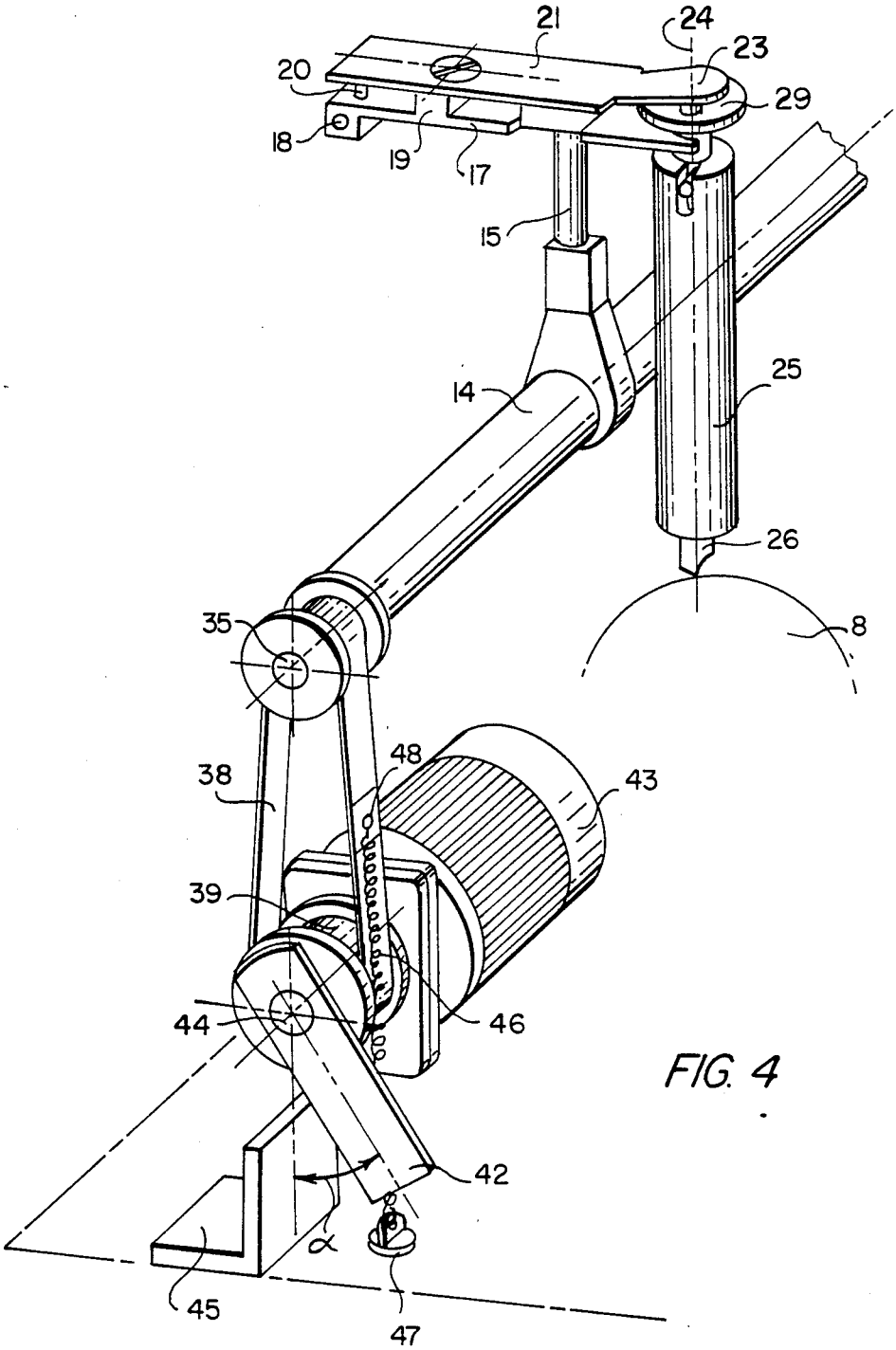
FIG. 4 is a view corresponding to FIG. 3, with the cutting tool in a lowered position, under spring pressure.

If the eccentric shaft 14 is turned on its axis 34, by a turning of the shaft segment 35, a corresponding downward displacement of the eccentric shaft 14 (and thereby of the connecting rod 15) is performed so that the arm 17 is pivoted around the shaft 18 in a clockwise direction (FIGS. 2 to 5). This results in a corresponding downward movement of the cutting tools 26, 27 inside the guide sleeve 25 to the point where the cutting element 26 comes to bear on material to be cut directly on top of the support roller 8. With any further downward movement of the forked distal end of straight arm 17, the forked end moves away from the underside of the annular collar 29. Hence, the cutting tool 26, 27 thereby cannot further move downward because it rests on the upper surface of material supported by support roller 8. This movement away from the underside of the annular collar 29 of the forked end of the arm 17 leads to an increase in the distance between the area 23 of the leaf spring, 21 (resting on the bearing element 28 of the cutting tool 26, 27) and the forked end of the arm 17. Therefore, there is a bending of the leaf spring 21, which is fastened on first protrusion 19 by means of the screw 22 and braced by second protrusion 20 proximate to the leaf spring end that is opposite from spring/tool contact point, 23. Such a deformed position of the leaf spring 21 is shown in FIG. 4, and it can clearly be seen that primarily only a spring force is being exerted on the rear end of the cutting tool 26, 27 to produce the penetrating force of the cutting element 26 into the material to be cut, because the forked end of the arm 17 no longer braces the cutting tool 26, 27 on the underside of the annular collar 29.

With a continued rotational movement, the forked end of the arm 17 finally will rest on the upper end surface of the guide sleeve 25, such that no further downward movement is possible (FIG. 5). In this position the maximum deformation of the spring 21 has been reached and, therefore, the spring 21, then imposes a maximum penetrating force to the cutting element 26 of the cutting tool.

Figure 6:
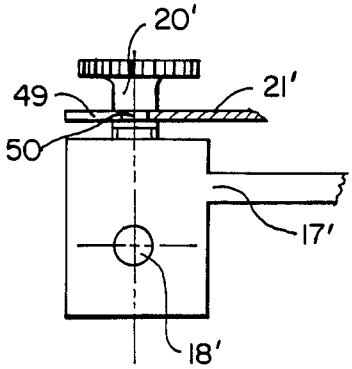
FIG. 6 is another embodiment of the bracing in the area of the circle C shown in FIG. 2.

In order to be able to adjust the pre-stressing of the leaf spring, as required, and as shown in FIG. 6, it is possible to replace the second protrusion 20 of FIGS. 2 to 5 set by a set screw 20', that can be inserted into a slit 49, open towards the rear, on a leaf spring 21'. The screw 20' can be screwed into the arm 17', next to the pivot shaft 18'. The edge area of the slit 49 then interacts with an annular groove 50 in the shaft of the set screw 20' such that this end of the leaf spring 21' can be raised or lowered by a corresponding turning of the set screw 20' by means of which the desired pre-stressing of the leaf spring can be attained.

It should be noted that the transverse pin 30 provided on a cutting tool 26, 27 will limit the downward movement of the cutting tool 26, 27 in a normal position where it rests on the bottom of slit 31 in guide sleeve 25. The normal position is set to just prevent a cutting or slicing of the support roller 8 by the cutting element 26.

The outer circumference of the shaft segment 35 is in the form of a toothed wheel (not shown) and is limited in the axial direction by two flanges 36, 37 for the purpose of providing a controlled back and forth movement of the cutting tools 26, 27 in the direction of the axis 24. An endless toothed belt 38 runs over this toothed wheel and the schematically indicated toothed wheel 39, which is limited in the axial direction by two flanges 40, 41 and is connected to drive shaft 44 of step motor 43. This drive shaft further includes a stop element 42 which, in the raised position of the cutting tools 26, 27, will rest upon a stationary stop (FIG. 3) formed by an angle piece 45. A tension spring 46, hooked into the toothed belt 38 at 48 and fastened with its other end to the eye of a stationary support 47, exerts a force on the toothed belt 38 which tends to pull stop element 42 against stop 45, and thereby brings cutting tool 26, 27 into a raised position, for example, when the step motor 43 is shut off or is without power because of a power failure.

By means of the controlled movement of the step motor 43, the drive shaft 44 can be displaced in comparatively small steps. For example, the stop element 42 can be displaced in a counter-clockwise direction an angle "a" from its end position in accordance with FIG. 3, in which it rests against the stop 45. This leads to a corresponding turn of the eccentric shaft in the direction of the arrow A (FIG. 3) until it reaches a position in accordance with FIG. 4. In FIG. 4, the arm 17 clears the underside of the annular collar 29 and the cutting element 26 of the cutting tool 26, 27 is pressed against the material to be cut by a defined force that is determined by the degree of deformation to deformed leaf spring 21.

Further pivoting of the stop element 42 around an angle å1 because of a corresponding excitation of step motor 43 leads, as shown in FIG. 5, to lowering of arm 17 to its lowest position, and also a maximum spring force action upon the cutting tool 26, 27.

A stepped movement of the motor 43 in the opposite direction, with the force of the spring 46, will move the stop element 42 back until it rests against the stop 45, because of which the cutting tool is again raised into the position of FIG. 3.

These lowering and raising movements are performed by the step motor with rapid speed and great accuracy and it is easily possible (by means of known NC controls) to create exact pivot movement of the stop element 42 from the position according to FIG. 3 and cause a corresponding movement of the eccentric shaft 14 that always ends in an exactly defined position. Hence, when working with a given sheet material, the same cutting pressure always is exerted thereupon, even if lowering and raising movements quickly follow each other because of the shape of the cuts being made.

While a preferred embodiment has been shown and described, the invention is to be defined by the scope of the appended claims.

I claim:

1. In a cutting device comprising a support roller (8) freely rotatable in both directions and able to absorb the pressure of cutting, a carrier (9) movable in the direction of the longitudinal axis of the support roller (8) that further comprises a cutting tool (26, 27) adapted to be pushed into contact with a portion of a roll of material to be cut that is present over the support roller (8), the improvement which comprises a means for lowering the cutting tool (26, 27) into an operating position and for raising from the operating position that comprises a rotatable eccentric element (14, 34) that is rotated against a returning force from a normal position that corresponds to a raised position of said cutting tool (26, 27), and said eccentric element is coupled with a pivotable straight arm (17) that is adapted to support the cutting tool (26, 27), wherein said means for lowering limits a raising and lowering movement of the cutting tool, and further comprises a leaf spring (21) that is fixed on the arm (17) with a free end braced against the upper end (28) of the cutting tool (26, 27), so that the vertical distance between a front tip and the upper end (28) of the cutting tool (26, 27) is greater than the minimum vertical distance between the support roller (8) and that portion of leaf spring (21), which normally rests against on the upper end (28) of the cutting tool (26, 27), when the spring is relaxed because the cutting tool (26, 27) is absent.

2. A cutting device in accordance with claim 1, characterized in that the leaf spring is fastened on a first straight arm protrusion (19) at a portion (21) located between a leaf spring portion braced against an upper end (28) of the cutting tool (26, 27) and a leaf spring portion proximate to a pivot shaft (18) for the straight arm (17), wherein further the leaf spring (21) is braced by a second straight arm protrusion (20) that is proximate said pivot shaft (18).

3. A cutting device in accordance with claim 2, characterized in that the second protrusion (20) has the same height as the first protrusion (19).

4. A cutting device in accordance with claim 3, characterized in that a downwardly facing bearing surface (29) is located below an upper end element (28) of the cutting tool (26, 27) and is adapted to engage the straight arm (17) so as to raise and support the cutting tool (26, 27), wherein the distance of the bearing surface (29) from an upper surface (23) of the cutting tool (26, 27) is substantially equal to the height of the first protrusion support (19).

5. A cutting device in accordance with claim 3, characterized in that the cutting tool (26, 27) comprises means for axial movement, up and down, within a stationary guide sleeve (25).

6. A cutting device in accordance with claim 5, characterized in that said means for axial movement comprises at least one radially outward extending pin (30) on the cutting tool (26, 27) that engages with an upwardly open slit (31) in the guide sleeve (25) that is parallel to the axis of the cutting tool.

7. A cutting device in accordance with claim 3, characterized in that the rotatable eccentric element is an eccentric shaft (14, 34) that is connected via a connecting rod (15) with the arm (17).

8. A cutting device in accordance with claim 7, characterized in that the eccentric shaft (14, 34) is drivingly connected with a step motor (43).

9. A cutting device in accordance with claim 8, characterized in that the device connection between the eccentric shaft (14, 34) and the step motor (43) is formed by a toothed belt (38).

10. A cutting device in accordance with claim 2, characterized in that the second protrusion comprises a set screw (20') for changing a pre-stress within the leaf spring (21').

11. A cutting device in accordance with claim 10, characterized in that a downwardly facing bearing surface (29) is located below an upper end element (28) of the cutting tool (26, 27) and is adapted to engage the straight arm (17) so as to raise and support the cutting tool (26, 27), wherein the distance of the bearing surface (29) from an upper surface (23) of the cutting tool (26, 27) is substantially equal to the height of the first protrusion support (19).

12. A cutting device in accordance with claim 10, characterized in that the cutting tool (26, 27) comprises means for axial movement, up and down, within a stationary guide sleeve (25).

13. A cutting device in accordance with claim 12, characterized in that said means for axial movement comprises at least one radially outward extending pin (30) on the cutting tool (26, 27) that engages with an upwardly open slit (31) in the guide sleeve (25) that is parallel to the axis of the cutting tool.

14. A cutting device in accordance with claim 10, characterized in that the rotatable eccentric element is an eccentric shaft (14, 34) that is connected via a connecting rod (15) with the arm (17).

15. A cutting device in accordance with claim 14, characterized in that the eccentric shaft (14, 34) is drivingly connected with a step motor (43).

16. A cutting device in accordance with claim 15 characterized in that the drive connection between the eccentric shaft (14, 34) and the step motor (43) is formed by a toothed belt (38).

17. A cutting device in accordance with claim 2, characterized in that a downwardly facing bearing surface (29) is located below an upper end element (28) of the cutting tool (26, 27) and is adapted to engage the straight arm (17) so as to raise and support the cutting tool (26, 27), wherein the distance of the bearing surface (29) from an upper surface (23) of the cutting tool (26, 27) is substantially equal to the height of the first protrusion support (19).

18. A cutting device in accordance with claim 17, characterized in that the cutting tool (26, 27) comprises means for axial movement, up and down, within a stationary guide sleeve (25).

19. A cutting device in accordance with claim 18, characterized in that said means for axial movement comprises at least one radially outward extending pin (30) on the cutting tool (26, 27) that engages with an upwardly open slit (31) in the guide sleeve (25) that is parallel to the axis of the cutting tool.

20. A cutting device in accordance with claim 17, characterized in that the rotatable eccentric element is an eccentric shaft (14, 34) that is connected via a connecting rod (15) with the arm (17).

21. A cutting device in accordance with claim 20, characterized in that the eccentric shaft (14, 34) is drivingly connected with a step motor (43).

22. A cutting device in accordance with claim 21, characterized in that the drive connection between the eccentric shaft (14, 34) and the step motor (43) is formed by a toothed belt (38).

23. A cutting device in accordance with claim 2, characterized in that the cutting tool (26, 27) comprises means for axial movement, up and down, within a stationary guide sleeve (25).

24. A cutting device in accordance with claim 23, characterized in that said means for axial movement comprises at least one radially outward extending pin (30) on the cutting tool (26, 27) that engages with an upwardly open slit (31) in the guide sleeve (25) that is parallel to the axis of the cutting tool.

25. A cutting device in accordance with claim 2, characterized in that the rotatable eccentric element is an eccentric shaft (14, 34) that is connected via a connecting rod (15) with the arm (17).

26. A cutting device in accordance with claim 25, characterized in that the eccentric shaft (14, 34) is drivingly connected with a step motor (43).

27. A cutting device in accordance with claim 26, characterized in that the drive connection between the eccentric shaft (14, 34) and the step motor (43) is formed by a toothed belt (38).

28. A cutting device in accordance with claim 1, characterized in that the cutting tool (26, 27) comprises means for axial movement, up and down, within a stationary guide sleeve (25).

29. A cutting device in accordance with claim 28, characterized in that said means for axial movement comprises at least one radially outward extending pin (30) on the cutting tool (26, 27) that engages with an upwardly open slit (31) in the guide sleeve (25) that is parallel to the axis of the cutting tool.

30. A cutting device in accordance with claim 1, characterized in that the rotatable eccentric element is an eccentric shaft (14, 34) that is connected via a connecting rod (15) with the arm (17).

31. A cutting device in accordance with claim 30, characterized in that the eccentric shaft (14, 34) is drivingly connected with a step motor (43).

32. A cutting device in accordance with claim 31, characterized in that the drive connection between the eccentric shaft (14, 34) and the step motor (43) is formed by a toothed belt (38).

* * * * *